US007250909B2

(12) United States Patent
Fujishima et al.

(10) Patent No.: US 7,250,909 B2
(45) Date of Patent: Jul. 31, 2007

(54) ANTENNA AND METHOD OF MAKING THE SAME

(75) Inventors: Tomoyasu Fujishima, Neyagawa (JP); Kazuyuki Sakiyama, Shijonawate (JP); Ushio Sangawa, Ikoma (JP); Hiroshi Kanno, Osaka (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 258 days.

(21) Appl. No.: 11/173,049

(22) Filed: Jul. 1, 2005

(65) Prior Publication Data

US 2005/0264452 A1 Dec. 1, 2005

Related U.S. Application Data

(63) Continuation of application No. PCT/JP2004/012249, filed on Aug. 19, 2004.

(30) Foreign Application Priority Data

Aug. 27, 2003 (JP) ..... 2003-303376

(51) Int. Cl.
*H01Q 1/38* (2006.01)

(52) U.S. Cl. ..... 343/700 MS; 343/84.6

(58) Field of Classification Search ..... 343/700 MS, 343/702, 846, 848
See application file for complete search history.

(56) References Cited

U.S. PATENT DOCUMENTS 5,063,389 A 11/1991 Reits
5,444,454 A 8/1995 White
5,619,365 A 4/1997 Rhoads et al.
6,061,025 A 5/2000 Jackson et al.
6,195,048 B1 * 2/2001 Chiba et al. ..... 343/700 MS
6,198,438 B1 3/2001 Herd et al.
6,255,994 B1 * 7/2001 Saito ..... 343/700 MS
6,384,785 B1 5/2002 Kamogawa et al.
6,483,462 B2 * 11/2002 Weinberger ..... 343/700 MS (Continued)

FOREIGN PATENT DOCUMENTS

EP 0 474 490 A1 9/1991

(Continued)

OTHER PUBLICATIONS

International Search Report for corresponding Application No. PCT/JP2004/012249 mailed Nov. 16, 2005.

*Primary Examiner*—Hoanganh Le
(74) *Attorney, Agent, or Firm*—Renner, Otto, Boisselle & Sklar, LLP

(57) ABSTRACT

An antenna according to the present invention includes a dielectric layer 102 with an upper surface and a lower surface, a signal line strip 101 provided on the upper surface of the dielectric layer 102, and a grounding conductor portion 104 provided on the lower surface of the dielectric layer 102. The surface of the grounding conductor portion 104 includes a plurality of planar areas, each of which has a size that is shorter than the wavelength of an electromagnetic wave to transmit or receive. A distance from a virtual reference plane to each planar area is adjusted on an area-by-area basis. Thus, an antenna, which can change various antenna parameters such as radiation directivity, gain and efficiency dynamically and adaptively according to incessantly changing propagation environment of radio wave, is provided.

16 Claims, 13 Drawing Sheets

U.S. PATENT DOCUMENTS

| | | | | |
|---|---|---|---|---|
| 6,700,540 | B2 * | 3/2004 | Holshouser | 343/700 MS |
| 6,717,605 | B2 | 4/2004 | Miyamaru | |
| 2005/0012675 | A1 | 1/2005 | Sakiyama et al. | |

FOREIGN PATENT DOCUMENTS

| | | | |
|---|---|---|---|
| EP | 1 003 223 | A2 | 11/1999 |
| GB | 2 335 798 | A | 9/1999 |
| JP | 51-79535 | | 7/1976 |
| JP | 62-196903 | | 8/1987 |
| JP | 03-179903 | | 8/1991 |
| JP | 05-343915 | | 12/1993 |
| JP | 08-307144 | | 11/1996 |
| JP | 09-148840 | | 6/1997 |
| JP | 2833802 | | 10/1998 |
| JP | 2869891 | | 1/1999 |
| JP | 11-266114 | | 9/1999 |
| JP | 2002-228948 | | 8/2002 |
| JP | 2002-228952 | | 8/2002 |
| WO | 01/71849 | A2 | 9/2001 |
| WO | 01/80258 | A2 | 10/2001 |

* cited by examiner (a)

(b)

ANTENNA AND METHOD OF MAKING THE SAME

This is a continuation of International Application PCT/JP2004/012249, with an international filing date of Aug. 19, 2004.

BACKGROUND OF THE INVENTION

1. Field of the Invention

The present invention relates to an antenna for use in a wireless communication device that utilizes electromagnetic wave such as microwave or millimeter wave. The present invention can be used particularly effectively in a wireless LAN (local area network) used in office and homes and mobile communications terminals such as cell phones.

2. Description of the Related Art

Conventional RF circuits for use in wireless communication devices that utilize microwave to millimeter wave frequency bands include circuits that use a coaxial line or a waveguide tube and circuits that use a planar substrate. Generally speaking, circuits using a coaxial line or a waveguide tube have a low loss but often make a thick, heavyweight and lengthy system. On the other hand, a microstrip circuit, a coplanar circuit and other circuits fabricated on a planar substrate tends to have an increased transmission loss but are flat, small-sized and lightweight. In addition, those circuits also have beneficial features that they can be formed easily as printed circuits on a dielectric substrate and that various surface-mount semiconductor devices can be used thereon. That is why an antenna taking advantage of these features is often used as a wireless circuit in a mobile communications terminal station for a cell phone or a wireless LAN.

There is often a radio wave obstruction such as something shielding or reflecting the radio wave between a mobile communications terminal station and a base station. Besides, the radio wave propagation environment frequently changes in a complicated manner due to the shift of the location of such a radio wave obstruction or mobile communications terminal station. On top of that, the mobile communications terminal station should be as small-sized and lightweight as possible, and therefore, can use only a limited quantity of power. For that reason, to maintain wireless communication as long as possible, the power dissipation is preferably minimized.

To maintain the wireless communications link at an appropriate level under such an environment, the antenna radiation properties (e.g., the gain and the directivity) of the mobile communications terminal station are preferably adaptively changeable according to the situation. More specifically, the directivity of the antenna at the terminal station is preferably changed dynamically into a direction in which connection can be established appropriately with the antenna at the base station. This requirement should be satisfied more fully in making communications over the high frequency band (e.g., millimeter wave), in particular.

Hereinafter, a microstrip antenna, which is a typical conventional planar antenna, will be described with reference to FIG. 17. A typical conventional microstrip antenna is described in Japanese Patent Application Laid-Open Publication No. 5-343915, for example.

FIG. 17 schematically illustrates the microstrip antenna disclosed in Japanese Patent Application Laid-Open Publication No. 5-343915. The antenna shown in FIG. 17 includes a dielectric layer 701, a driven element 702 provided on the upper surface of the dielectric layer 701, a grounded conductor 703 provided on the lower surface of the dielectric layer 701, a non-driven element 704 provided so as to face the driven element 702, a dielectric substrate 705 located under the grounded conductor 703, and a microstrip line 706 located on the lower surface of the dielectric substrate 705. A slot 707 is defined in the grounded conductor 703 and is located between the driven element 702 and the microstrip line 706. The driven element 702 and non-driven element 704 are square in FIG. 17 but may also have a circular shape.

As can be seen from FIG. 17, the driven element 702 and the microstrip line 706 are arranged so as to sandwich the grounded conductor 703 between them, and the slot 707 is located under the center portion of the driven element 702. Thus, the microwave that has propagated through the microstrip line 706 is coupled to the electromagnetic field in the antenna by way of the slot 707, thereby exciting a fundamental-mode electromagnetic field in the antenna. FIG. 18 shows a radiation pattern in a situation where such a mode has been excited.

In maintaining wireless communication either through a mobile communications terminal station or in a room where a number of persons go back and forth frequently, the radio wave propagation environment changes successively due to shielding or reflection as described above. For that reason, to keep up a good communication link, the antenna properties are preferably controllable adaptively.

In the conventional antenna shown in FIG. 17, however, various properties thereof such as the directivity, gain and efficiency are determined by its fixed antenna shape. That is why it is difficult to change those various antenna properties dynamically in response to any change in radio wave propagation environment.

Also, even if the antenna properties do not have to be changed dynamically, the properties of the antenna being designed are still preferably assessed while changing the antenna shape such that the best antenna properties can be adopted according to various environments.

Japanese Patent Application Laid-Open Publication No. 62-196903 discloses a planar antenna in which a number of microstrip line conductors are arranged over the entire surface. In such a planar antenna, the distance between the surface on which the array of microstrip line conductors is provided and the grounded conductor is changed according to the situation. However, in a planar antenna with such a structure, that distance is changed by shifting the grounded conductor entirely. Accordingly, there are just a few parameters that affect the antenna properties and the variation range of the antenna properties is too narrow.

SUMMARY OF THE INVENTION

In order to overcome the problems described above, a primary object of the present invention is to provide an antenna that can strike an overall best balance among various antenna parameters such as directivity, gain and efficiency according to the radio wave propagation environment.

Another object of the present invention is to provide an apparatus and method for designing an antenna with required antenna properties easily.

An antenna according to the present invention includes: a dielectric layer with an upper surface and a lower surface; a feeding conductor pattern, which is provided on the upper surface of the dielectric layer; and a grounding conductor portion, which is provided on the lower surface of the dielectric layer. The surface of the grounding conductor portion includes a plurality of planar areas, each of which has a size that is shorter than the wavelength of an electromagnetic wave to transmit or receive. A distance from a virtual reference plane to each said planar area is adjusted on an area-by-area basis.

In one preferred embodiment, the grounding conductor portion includes an array of conductor elements, each of which defines an associated one of the planar areas, and the distance from at least one of the conductor elements to the reference plane is changeable.

In another preferred embodiment, the antenna includes a driving section, which is able to change the distance from the at least one selected conductor element to the reference plane.

In another preferred embodiment, the driving section is able to change respective positions and/or directions of some of the conductor elements independently of each other.

In another preferred embodiment, each said conductor element has a size that is shorter than the wavelength of an electromagnetic wave to transmit or receive.

In another preferred embodiment, the driving section includes an actuator produced by an MEMS.

In another preferred embodiment, each said conductor element has a principal surface that is parallel to the reference plane, and the driving section is able to move the principal surface up and down perpendicularly to the reference plane while keeping the principal surface parallel to the reference plane.

In another preferred embodiment, the conductor elements are arranged in columns and rows to define a matrix pattern.

In another preferred embodiment, each said conductor element has a rectangular principal surface, and the sizes of the respective principal surfaces are substantially equal to each other.

In another preferred embodiment, the at least one selected conductor element is grounded to define a grounded conductor portion.

In another preferred embodiment, the dielectric layer is an air layer.

In another preferred embodiment, the dielectric layer is a dielectric plate.

In another preferred embodiment, the feeding conductor pattern includes a signal line strip.

Another antenna according to the present invention includes: a dielectric layer with an upper surface and a lower surface; a feeding conductor pattern, which is provided on the upper surface of the dielectric layer; and a grounding conductor portion, which is provided on the lower surface of the dielectric layer. The grounding conductor portion is provided on the principal surface of a substrate. The principal surface of the substrate includes a plurality of unit areas, which are arranged in columns and rows so as to define a matrix pattern. The size of each said unit area is smaller than the wavelength of an electromagnetic wave to transmit or receive. The distances from the respective surfaces of the unit areas to a reference plane are defined in advance on an area-by-area basis.

In one preferred embodiment, the substrate is located between the conductor portion and the feeding conductor pattern and functions as the dielectric layer.

In another preferred embodiment, the principal surface of the substrate includes a plurality of unit areas, which are arranged in columns and rows so as to define a matrix pattern, and the distances from the respective surfaces of the unit areas to the reference plane are defined in advance on an area-by-area basis.

In another preferred embodiment, the principal surface of the substrate includes a plurality of planar areas, to which the distances from the reference plane are different from one location to another.

In another preferred embodiment, the minimum size of the planar areas is smaller than the wavelength of an electromagnetic wave to transmit or receive.

An apparatus according to the present invention includes one of the antennas described above, and a circuit, which is electrically connected to the feeding conductor pattern and the grounding conductor portion of the antenna.

Another apparatus according to the present invention includes one of the antennas described above; a circuit, which is electrically connected to the feeding conductor pattern and the grounding conductor portion of the antenna; and a control section for controlling the shape of the antenna so as to change a distance from at least one of the conductor elements to the reference plane.

An antenna control system according to the present invention includes: one of the antennas described above; a circuit, which is electrically connected to the feeding conductor pattern and the grounding conductor portion of the antenna; an antenna shape control section for controlling the shape of the antenna so as to change a distance from at least one of the conductor elements to the reference plane; and antenna property assessing means for assessing the antenna properties of the antenna by transmitting and/or receiving electromagnetic wave through the antenna with the circuit operated. Based on the antenna properties assessed by the antenna property assessing means, the distances from the conductor elements to the reference plane are determined and the shape of the antenna is controlled.

A method of making an antenna according to the present invention includes the steps of: (a) preparing one of the antennas described above; (b) controlling the shape of the antenna so as to change a distance from at least one of the conductor elements to the reference plane; (c) assessing the antenna properties of the antenna; and (d) determining the distances from the conductor elements to the reference plane based on the antenna properties assessed by performing the steps (b) and (c) at least once.

A method of controlling an antenna according to the present invention includes the steps of: (a) preparing any of the antennas described above; (b) controlling the shape of the antenna so as to change a distance from at least one of the conductor elements to the reference plane; (c) assessing the antenna properties of the antenna; (d) determining the distances from the conductor elements to the reference plane based on the antenna properties assessed by performing the steps (b) and (c) at least once; and (e) controlling the shape of the antenna based on the distances, determined in the step (d), so as to change the distance from the at least one selected conductor element to the reference plane.

DETAILED DESCRIPTION OF PREFERRED EMBODIMENTS

Figure 1:
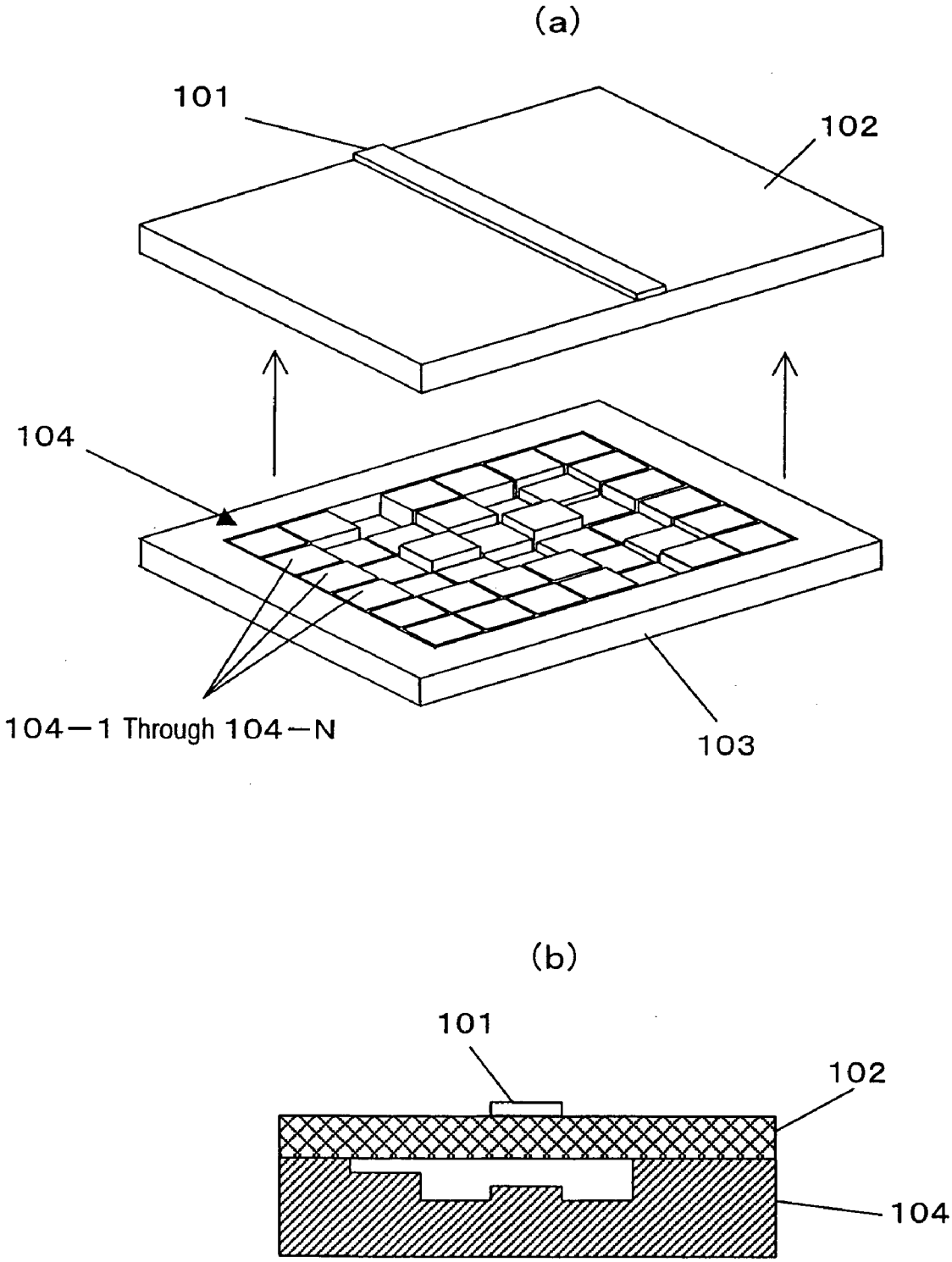
FIGS. 1(*a*) and 1(*b*) are respectively a perspective view and a cross-sectional view illustrating a first preferred embodiment of an antenna according to the present invention.

Hereinafter, preferred embodiments of the present invention will be described with reference to the accompanying drawings.

As described above, the design of a normal conventional planar antenna was limited by the degree of design freedom of an antenna shape that determines either electric or magnetic current. For example, some people have. tried to optimize the antenna properties of a microstrip antenna by making the shape of a feeding conductor pattern a best possible one. As used herein, the "feeding conductor pattern" refers to a conductor portion (consisting of a signal line and a resonator structure) that is provided in a particular shape on the upper surface of a dielectric layer. In an ordinary planar antenna, the feeding conductor pattern is arranged on the upper surface of a dielectric layer, while a grounding conductor portion is arranged on the lower surface of that dielectric layer. The dielectric layer is usually made of a solid material with dielectric property but may also be a fluid such as the air.

In the prior art, in designing such a planar antenna, the grounding conductor portion is not taken into consideration as the object of design modification for the purpose of optimizing the antenna properties. Actually, however, electric or magnetic current, which has a conjugate relationship with the electric or magnetic current flowing through the feeding conductor pattern, also flows through such a grounding conductor portion. The present inventors paid special attention to this fact and discovered that the electric or magnetic current could also be controlled, and eventually the antenna properties could too be changed, even by modifying the shape of the grounding conductor portion, thereby acquiring the basic idea of the present invention.

It is already known in the art, and disclosed in Japanese Patent Application Laid-Open Publication No. 62-196903 mentioned above, for example, that the effective dielectric constant of a microstrip line changes when the distance from the strip line to the grounded conductor is changed. The prior art disclosed in this document uses a variation in the electrical path length of an electromagnetic wave to be guided. Meanwhile, according to the present invention, the antenna properties are controlled by changing the shape of the grounded conductor. In general, supposing a finite space including the antenna is identified by V, the vector potential A and magnetic vector potential Am respectively satisfy the following Equations (1) and (2) with respect to the current density J and magnetic current density M:

$$A(r) \propto \int_v J(r')\exp(jk\bar{r}\cdot r')\,dv \tag{1}$$

$$A_m(r) \propto \int_v M(r')\exp(jk\bar{r}\cdot r')\,dv \tag{2}$$

where r is a point located far away from the antenna, r' is a point located within the finite space V, r with bar is the unit vector, k is the wave number and j is the imaginary unit. According to the present invention, the antenna is designed such that this integral has a finite value by modifying the shape of the grounded conductor. When the vector potential A and magnetic vector potential Am have finite values, the electromagnetic field can be radiated far enough.

According to a preferred embodiment of the present invention, there is no need to provide a plurality of strip lines or to form the strip line in a special shape. Instead, just by designing the grounding conductor portion in an arbitrary shape, the radiation properties (e.g., frequency and directivity) of the antenna can be controlled.

In addition, according to a preferred embodiment of the present invention, when a movable mechanism that can change the surface shape of the grounding conductor portion dynamically is provided for the grounding conductor portion, the antenna radiation properties, including the directivity, gain and resonant frequency, can be changed at any time. Consequently, it is possible to control the radiation properties according to the radio wave propagation environment and always achieve the best possible properties.

Hereinafter, specific preferred embodiments of the present invention will be described with reference to the accompanying drawings.

Embodiment 1

First, a first preferred embodiment of an antenna according to the present invention will be described with reference to FIGS. 1(*a*) and 1(*b*). FIGS. 1(*a*) and 1(*b*) are respectively an exploded perspective view and a cross-sectional view illustrating the antenna of this preferred embodiment.

As shown in FIGS. 1(*a*) and 1(*b*), the antenna of this preferred embodiment includes a dielectric layer 102, which has an upper surface (which will also be referred to herein as the "front side" on which a feeding line is provided) and a lower surface (which will be also referred to herein as the "backside" on which a grounded conductor is provided), a signal line strip (i.e., feeding conductor pattern) 101 arranged on the upper surface of the dielectric layer 102, a grounding conductor portion 104 arranged on the lower surface of the dielectric layer 102, and a supporting member 103 to support the grounding conductor portion 104.

The grounding conductor portion 104 of this preferred embodiment is characterized primarily by having a "surface" on which the distance from a virtual reference plane changes from one location to another. According to this preferred embodiment, the "surface" of the grounding conductor portion 104 refers to portions of the entire surface of the grounding conductor portion 104, which are either opposed to, or in contact with, the lower surface of the dielectric layer 102. In this preferred embodiment, the "reference plane" may be either the upper surface of the dielectric layer 102 or a plane that is defined parallel to this upper surface.

The grounding conductor portion 104 of this preferred embodiment includes a number N (which is an integer equal to or greater than two) of conductor elements 104-1 through 104-N that are arranged in the recess of the supporting member 103 with a square frame raised portion. In this preferred embodiment, the conductor elements 104-1 through 104-N are supported so as to have variable distances from the reference plane, and the "surface" of the grounding conductor portion 104 is defined by the respective tops of the conductor elements 104-1 through 104-N.

In this preferred embodiment, the N conductor elements 104-1 through 104-N can be moved up and down (i.e., perpendicularly to the reference plane) independently of each other. Thus, by adjusting the distances from the reference plane to the respective tops of these conductor elements 104-1 through 104-N, the overall shape of the grounding conductor portion 104 can be changed, whereby the antenna properties can be controlled.

In the example illustrated in FIG. 1, the gap between the upper surface of the grounding conductor portion 104 and the lower surface of the dielectric layer 102 changes according to the location of the conductor element as is clear from FIG. 1(*b*). For the sake of simplicity, the grounding conductor portion 104 and the supporting member 103 are illustrated in FIG. 1(*b*) as if they were integrated together. Actually, however, the supporting member 103 does not have to function as a portion of the grounding conductor portion 104 but may be made of an insulator. In other cases, at least a part of the supporting member 103, which is either opposed to or in contact with the lower surface of the dielectric layer 102, may be an electrically conductive portion, which may function as a part of the grounding conductor portion 103. Also, in the example illustrated in FIGS. 1(*a*) and 1(*b*), the dielectric layer 102 and the supporting member 104 are designed such that the dimensions of the lower surface of the dielectric layer 102 are equal to the outer dimensions of the supporting member 103. However, the antenna of the present invention is no way limited to this specific example. Alternatively, the supporting member 104 may be designed with increased outer dimensions such that the combined upper surface area of the conductor elements 104-1 through 104-N is substantially equal to the lower surface area of the dielectric layer 102.

In this preferred embodiment, each of the conductor elements 104-1 through 104-N has a square upper surface as shown in FIG. 1(*a*) and these conductor elements 104-1 through 104-N have the same size. Also, the conductor elements 104-1 through 104-N are arranged in n rows and m columns so as to define a matrix pattern (i.e., N=n×m, where n and m are both positive integers).

The upper surface of each of these conductor elements 104-1 through 104-N has dimensions that are smaller than the wavelength of the radio wave to transmit or receive and that may be several millimeters square and may even be one millimeter square or less depending on the frequency of the radio wave. However, the upper surface of the conductor elements 104-1 through 104-N does not have to be square but may also be a triangular or polygonal shape with a number M (which is an integer equal to or greater than five) of sides.

Furthermore, the contours of the upper surface of the conductor elements 104-1 through 104-N may be curved either partially or even entirely. What is more, those conductor elements 104-1 through 104-N, forming the single grounding conductor portion 104, do not have to have the same type of upper surfaces. That is to say, not all of these conductor elements have to have the same shape or dimensions but conductor elements 104-1 through 104-N with a number of different shapes may be arranged as well. Also, adjacent conductor elements do not have to be arranged with no gap left between them. Optionally, there may be areas with no conductor elements on the supporting member 103.

Figure 2:
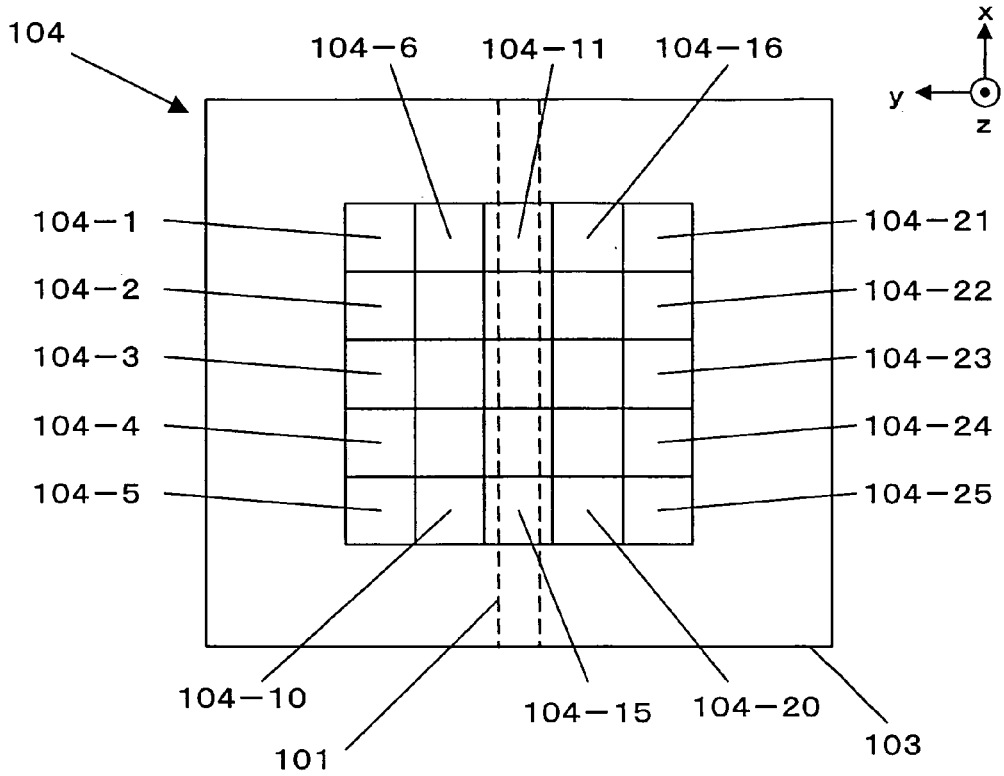
FIG. 2 is a plan view schematically illustrating the arrangement of a grounding conductor portion according to the first preferred embodiment of the present invention.

FIG. 2 illustrates a planar layout for conductor elements 104-1 through 104-N that are arranged in a 5×5 matrix (i.e., N=25). In FIG. 2, an xyz coordinate system is shown, in which the z-axis is defined as the direction coming out of the paper and the x-axis is defined as the direction in which the signal line strip 101 extends.

In the example illustrated in FIG. 2, each of the 25 conductor elements 104-1 through 104-N can be displaced in the z-axis direction. Various mechanisms may be used to displace these conductor elements 104-1 through 104-N in the z-axis direction. For example, very small recesses, having the same shapes as the conductor elements 104-1 through 104-N, may be arranged on the supporting member 103 so as to receive the conductor elements 104-1 through 104-N inserted. In that case, the respective conductor elements 104-1 through 104-N may be provisionally fixed at arbitrary z-axis positions. Then, the antenna itself includes no mechanism for changing the z-axis positions of the conductor elements 104-1 through 104-N. Accordingly, to change the z-axis positions of the conductor elements 104-1 through 104-N in that situation, external force that changes the z-axis position (i.e., force in the z-axis direction) needs to be applied from outside of the antenna to any of the conductor elements 104-1 through 104-N. For example, if the positional relationship between the conductor elements 104-1 through 104-N and the supporting member 103 is fixed due to the frictional force produced between the conductor elements 104-1 through 104-N and the inner wall of the recesses in the supporting member 103, then external force that overcomes this frictional force may be applied to a selected conductor element. Then, that conductor element can be displaced.

To change the z-axis position of an arbitrary conductor element both dynamically and adaptively without adopting such a method, either the antenna or an antenna module preferably includes a movable mechanism (e.g., a driving section such as an actuator). Such a driving section for operating a small conductor element with high precision may be implemented as a microelectromechanical system (MEMS), for example.

Hereinafter, examples of such movable mechanisms will be described with reference to FIG. 3 through 5.

Figure 3:
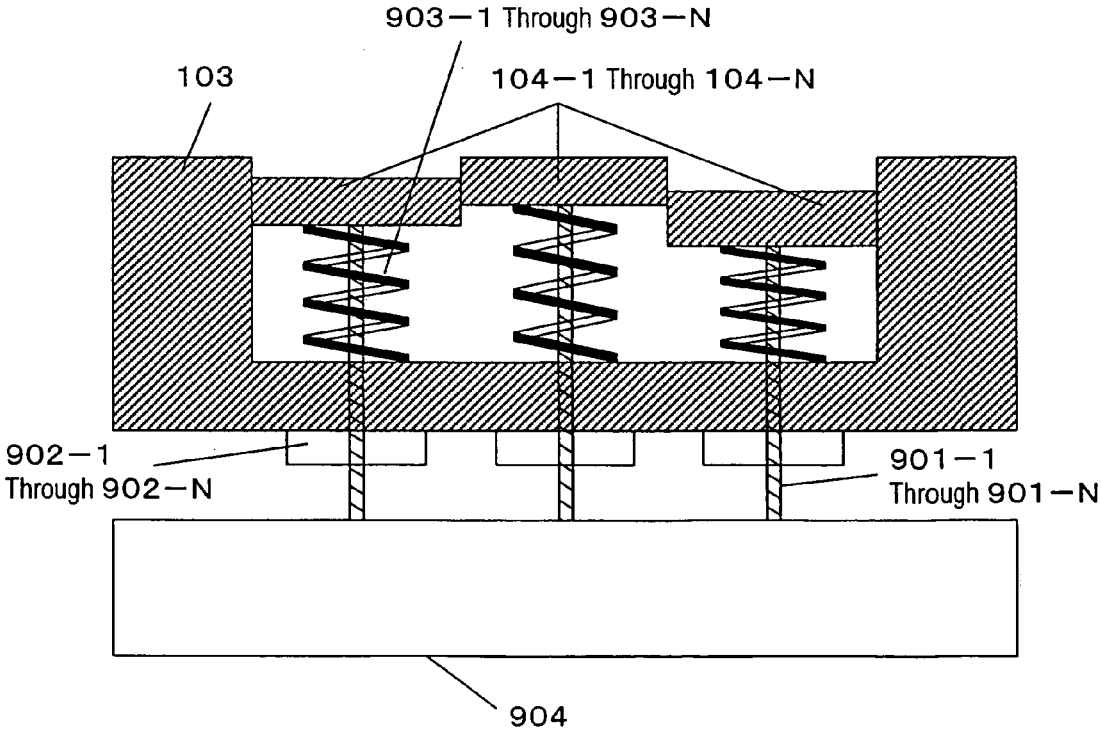
FIG. 3 schematically illustrates a movable mechanism for conductor elements that use screws.

First, referring to FIG. 3, the antenna has a movable mechanism including screws 901-1 through 901-N, nuts 902-1 through 902-N, and elastic springs 903-1 through 903-N. The respective screws 901-1 through 901-N are driven and rotated by a control section 904 that has associated actuators. The control section 904 includes a circuit for sending out a signal that drives an actuator at an arbitrarily selected position and can displace the respective conductor elements 104-1 through 104-N in the z-axis direction independently of each other.

Figure 4:
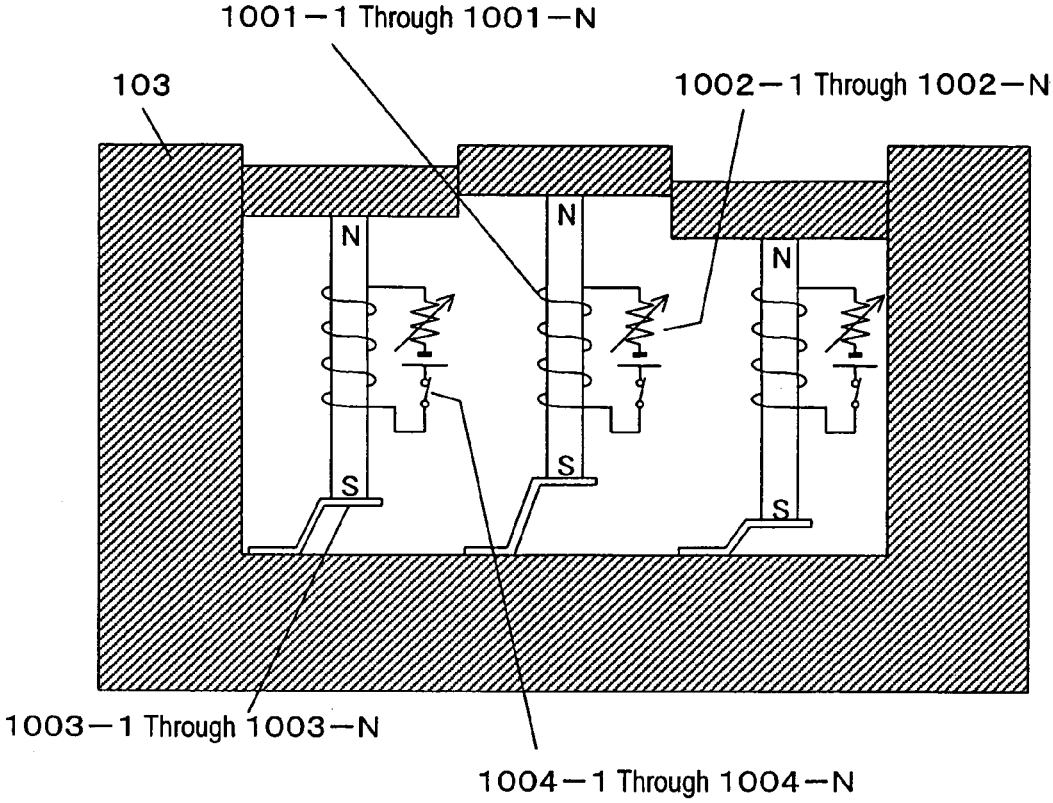
FIG. 4 schematically illustrates a movable mechanism for conductor elements that use solenoid coils.

FIG. 4 illustrates an antenna with another type of movable mechanism. The movable mechanism shown in FIG. 4 includes solenoid coils 1001-1 through 1001-N, variable resistors 1002-1 through 1002-N, springs 1003-1 through 1003-N and switches 1004-1 through 1004-N. By controlling the amount of current flowing through each of the solenoid coils 1001-1 through 1001-N, the magnitude of the magnetic field produced by that solenoid coil 1001-1 through 1001-N is controlled, thereby displacing the conductor elements 104-1 through 104-N in the z-axis direction independently of each other.

Figure 5:
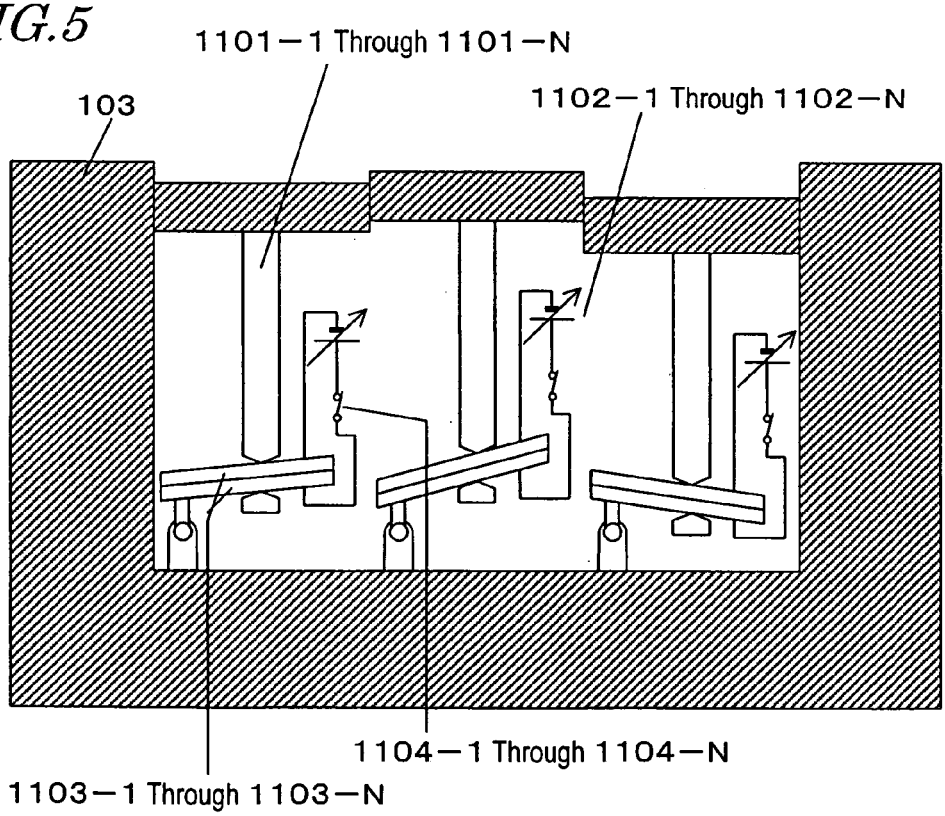
FIG. 5 schematically illustrates a movable mechanism for conductor elements that use piezoelectric elements.

FIG. 5 illustrates an antenna with still another type of movable mechanism. The movable mechanism shown in FIG. 5 includes supporting rods 1101-1 through 1101-N for supporting the conductor elements, piezoelectric elements 1103-1 through 1103-N coupled to the supporting rods 1101-1 through 1101-N, and variable constant-voltage power supplies 1102-1 through 1102-N and switches 1104-1 through 1104-N for regulating the voltages applied to the piezoelectric elements 1103-1 through 1103-N.

Each of the piezoelectric elements 1103-1 through 1103-N is an element obtained by bonding together two types of materials with mutually different piezoelectric coefficients and changes its bending angle in response to the applied voltage. By controlling the variable constant-voltage power supplies 1102-1 through 1102-N and switches 1104-1 through 1104-N, the voltages applied to the piezoelectric elements 1103-1 through 1103-N can be changed element by element. As a result, the z-axis positions of the supporting rods 1101-1 through 1101-N can be adjusted independently of each other.

Each of the movable mechanisms described above can displace the respective conductor elements 104-1 through 104-N perpendicularly to the supporting member 103 and can also fix them at any arbitrary positions as a result of the displacement. Alternatively, the antenna of the present invention may include a different type of movable mechanism, which is not illustrated in any of FIGS. 3 to 5. For example, the respective conductor elements may also be displaced by utilizing static electricity or a shape memory alloy.

In the antenna of the present invention, to make the grounding conductor portion 104 of a combination of conductor elements 104-1 through 104-N, at least some of these conductor elements 104-1 through 104-N need to be grounded. Such grounding may be done by directly interconnecting adjacent conductor elements together. Alternatively, even if adjacent conductor elements are electrically isolated from each other, the respective conductor elements may be directly connected to a grounding electrode by way of the movable mechanism, for example. Also, not all of the conductor elements that are arranged in the matrix pattern need to be grounded but some of the conductor elements may be floating without being grounded.

The antenna of this preferred embodiment changes the surface shape of the grounding conductor portion 104, thereby changing the two-dimensional distribution of the electromagnetic field within an antenna plane and eventually the pattern of electric or magnetic current flowing through the grounding conductor portion. In particular, by adopting an array structure in which the grounding conductor portion 104 is divided into a plurality of conductor elements, those conductor elements can be displaced independently of each other. Furthermore, by controlling the displacements of the respective conductor elements individually, various electromagnetic field distributions are realized. For example, a groove structure with a particular resonant frequency, a structure for changing the wave front of an electromagnetic wave to feed through the distribution of effective dielectric constants, and a structure as a combination of these structures are realized. Then, the frequency and directivity of a radiated electromagnetic wave can be controlled by taking advantage of the difference in shape between those antennas.

Thus, according to this preferred embodiment, the antenna properties can be changed appropriately and adaptively according to the frequency of the radio wave signal and the radio wave propagation environment surrounding the antenna.

EXAMPLE 1

Hereinafter, a specific example of an antenna according to the first preferred embodiment of the present invention will be described.

Figure 6:
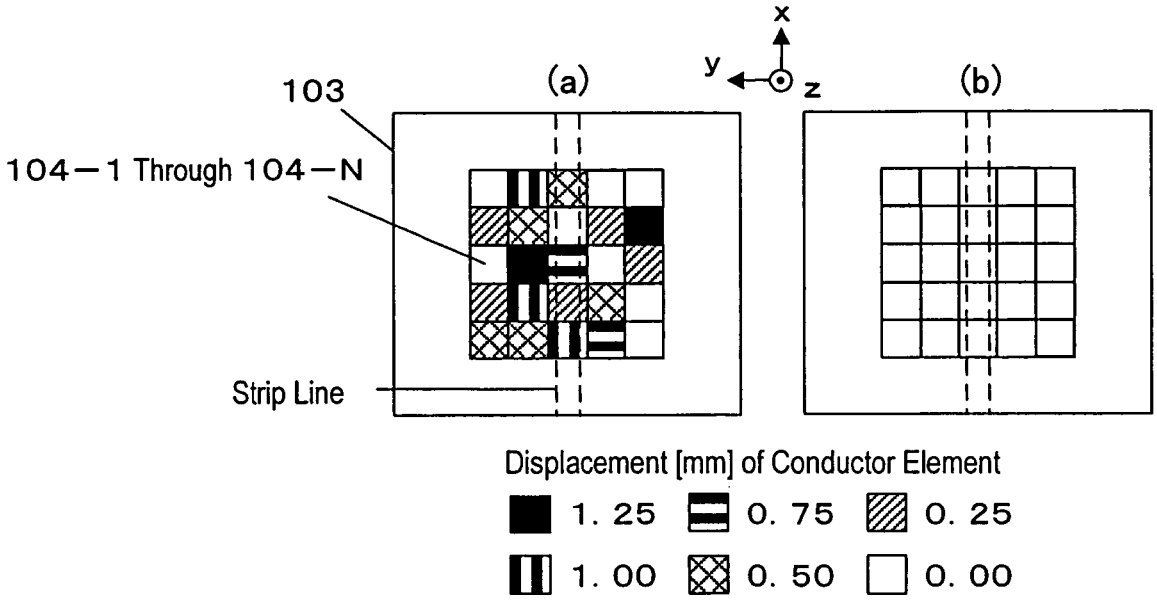
FIG. 6(*a*) shows the configuration of the grounding conductor portion in a first specific example of the first preferred embodiment of the present invention, and FIG. 6(*b*) shows a comparative example thereof.

First, referring to FIGS. 6(*a*) and 6(*b*), illustrated are the displacement pattern of conductor elements of this specific example in FIG. 6(*a*) and a comparative example, in which the respective tops of the conductor elements (i.e., a plurality of planar areas included on the surface of the grounding conductor portion) are located at the same distance from a reference plane, in FIG. 6(*b*), respectively.

In this specific example, the respective conductor elements 104-1 through 104-N have a square upper surface with a size of 0.6 mm each side and are arranged in a 5×5 matrix pattern. Outside of the array of the conductor elements 104-1 through 104-N, there is a frame-shaped raised portion of the supporting member 103. A conductor layer has been deposited on the upper surface of this raised portion, which combines with the respective upper surfaces of the conductor elements to define the "surface" of the grounding conductor portion. The overall surface of this grounding conductor portion may be a square with a size of 10 mm each side.

In the comparative example shown in FIG. 6(*b*), the surface of the grounding conductor portion is substantially flat and the distance from the reference plane is approximately constant irrespective of the location. In contrast, in the specific example illustrated in FIG. 6(*a*), the distance from the reference plane to the surface of the grounding conductor portion changes from one location to another. That is to say, the surface of the grounding conductor portion has a plurality of planar areas, of which the size is smaller than even the wavelength of the electromagnetic wave to transmit or receive, and the distance from a virtual reference plane to each of those planar areas is adjusted on an area-by-area basis. More specifically, the upper surface of each conductor element is displaced so as to be more distant from the dielectric layer (not shown) than the "surface" of the grounding conductor portion shown in FIG. 6(*b*) is. The upper surface of each of those conductor elements has a displacement of 0.00 mm, 0.25 mm, 0.50 mm, 0.75 mm, 1.00 mm or 1.25 mm.

In FIGS. 6(*a*) and 6(*b*), the location of the strip line on the upper surface of the dielectric layer is indicated by the dashed lines for reference. As can be seen from FIGS. 6(*a*) and 6(*b*), the strip line extends in the x-axis direction so as to cross the center of the grounding conductor portion. The microstrip line is fed through a port provided on the negative side of the x-axis, while a port provided on the positive side of the x-axis for the microstrip line is designed to reflect no inserted electromagnetic field.

The dielectric layer is provided on the positive side of the z-axis with respect to the grounding conductor portion. The dielectric layer of this specific example is a substrate made of a material with a dielectric constant of 3.5 and has a thickness of 0.3 mm.

Figure 7:
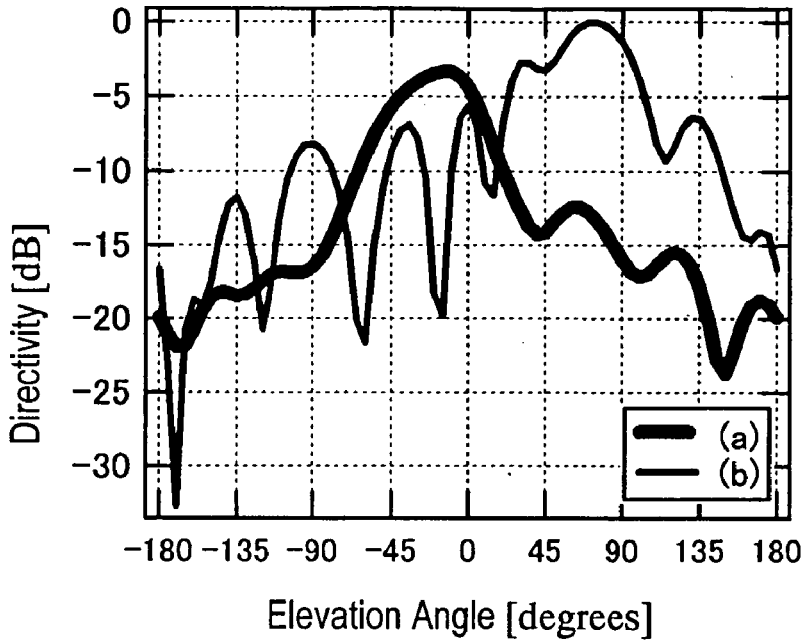
FIG. 7 is a graph showing the xz plane directivity of the first specific example of the first preferred embodiment of the present invention.

The farfield radiation directivity patterns in xz plane and yz plane of each antenna at a frequency of 60 GHz were evaluated. FIG. 7 is a graph showing the farfield radiation directivity in xz plane, while FIG. 8. is a graph showing the farfield radiation directivity in yz plane.

As can be seen from FIG. 7, if the conductor elements are not displaced at all (FIG. 6(*b*)), the directivity tends to be high in the positive x-axis direction (in which the elevation angle is positive) but the directivity is distributed in a broad range of directions overall. Meanwhile, the antenna in which the conductor elements are displaced (FIG. 6(*a*)) shows directivity at an elevation angle of −15 degrees.

Figure 8:
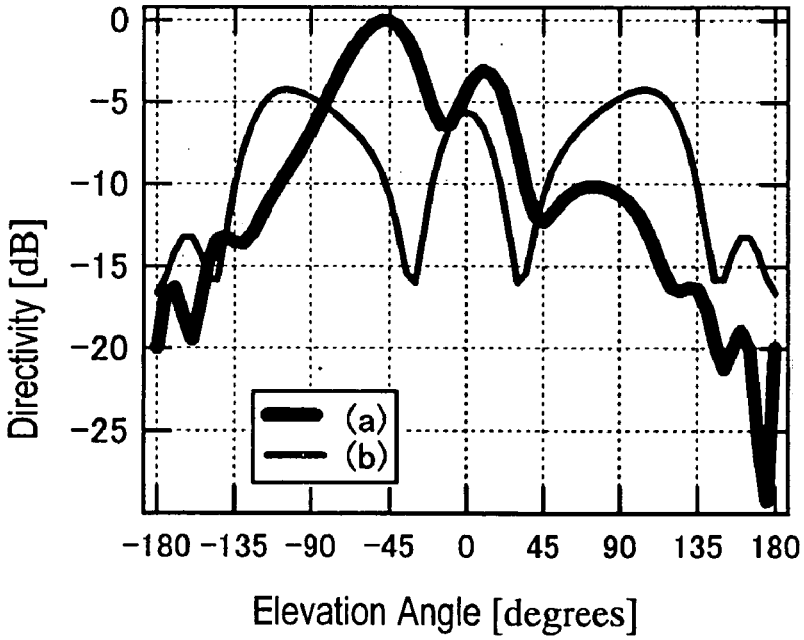
FIG. 8 is a graph showing the yz plane directivity of the first specific example of the first preferred embodiment of the present invention.

Also, as can be seen from FIG. 8, if the conductor elements are not displaced at all (FIG. 6(*b*)), then the yz plane directivity is symmetric with respect to an elevation angle of 0 degrees. On the other hand, if the conductor elements are displaced (FIG. 6(*a*)), then radiation directivity is produced at an elevation angle of −45 degrees.

Thus, the antenna shown in FIG. 6(*a*) has a directivity that cannot be achieved by the antenna shown in FIG. 6(*b*). This directivity is produced by varying the shape of the grounding conductor portion to change the amount of electric or magnetic current flowing through the grounding conductor portion and by taking advantage of the resultant variation in radiation characteristics.

If the displacement pattern of the conductor elements 104-1 through 104-N is modified, then the radiation characteristics of the antenna can be adjusted in various manners. Consequently, it is possible to optimize the antenna radiation characteristics dynamically and adaptively in response to any change in radio wave propagation environment.

EXAMPLE 2

Hereinafter, another specific example of an antenna according to the first preferred embodiment of the present invention will be described.

Figure 9:
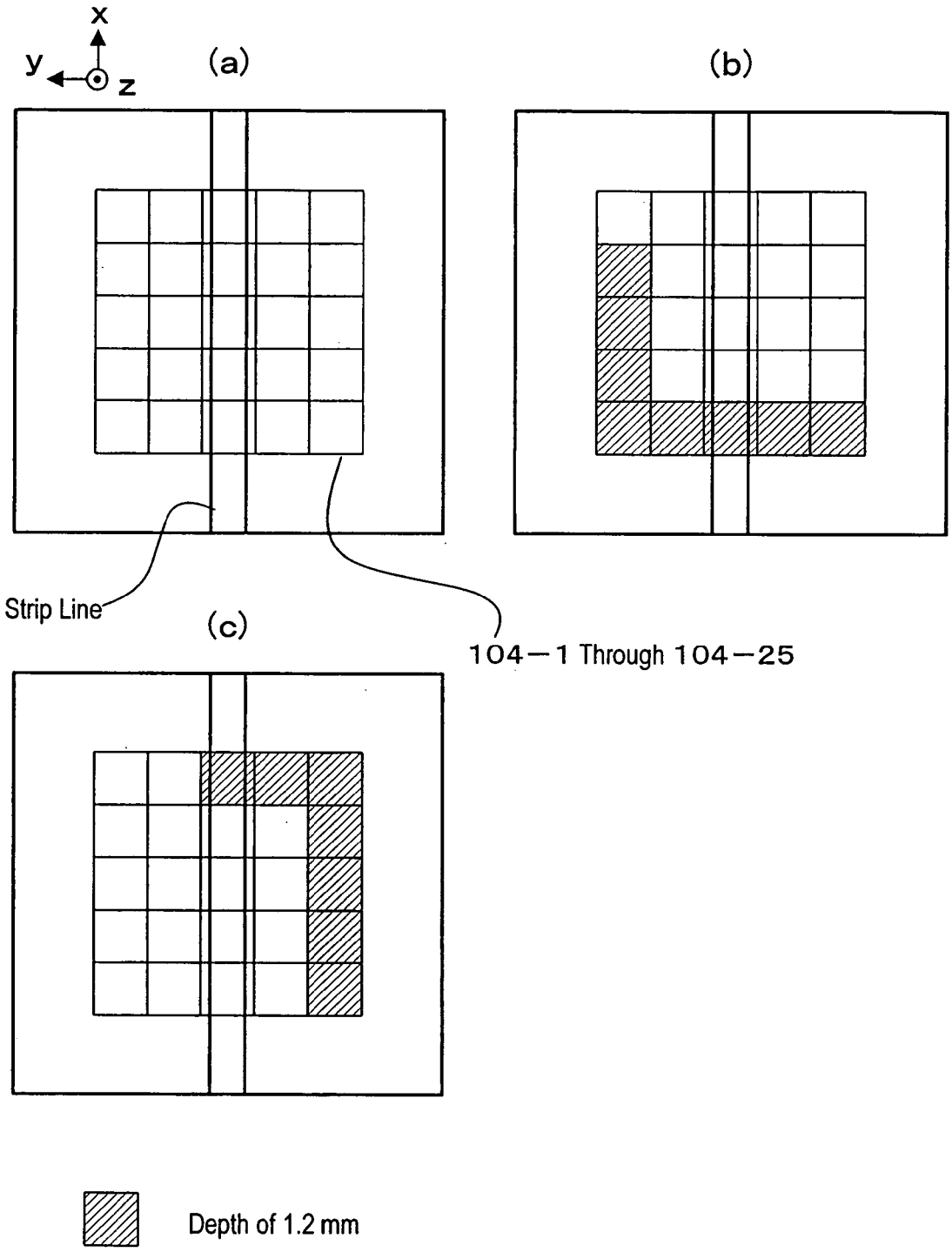
FIG. 9(*a*) illustrates a state of the grounding conductor portion according to a second specific example of the first preferred embodiment of the present invention in which the surface level of the conductor elements has not changed at all (comparative example), and FIGS. 9(*b*) and 9(*c*) illustrate two situations where the surface level of particular conductor elements has changed by 1.2 mm.

FIGS. 9(*a*) through 9(*b*) illustrate exemplary displacement patterns of grounding conductor elements 104-1 through 104-25 according to this specific example. In FIGS. 9(*b*) and 9(*c*), the position (i.e., the surface level) of the hatched conductor elements has shifted to a level that is 1.2 mm lower than-the reference plane. More specifically, in the example illustrated in FIG. 9(*a*), the surface of all conductor elements 104-1 through 104-25 is on a level with the reference plane and none of the conductor elements has been displaced at all. Accordingly, FIG. 9(*a*) shows a comparative example. On the other hand, in the examples illustrated in FIGS. 9(*b*) and 9(*c*), the surface of the eight or seven L-corner conductor elements has shifted to a level that is 1.2 mm lower than the reference plane, while the surface of the other conductor elements is still on a level with the reference plane.

In this specific example, the respective conductor elements 104-1 through 104-25 have a square upper surface with a size of 0.9 mm each side and are arranged in a 5×5 matrix pattern. Outside of the array of the conductor elements. 104-1 through 104-25, there is a conductor area, of which the surface is on a level with the reference plane. The overall surface of this grounding conductor portion may be a square with a size of 10 mm each side.

Thus, the antenna of this specific example is designed so as to operate around a frequency of 30 GHz. Meanwhile, the antenna of the first specific example described above is designed so as to operate around a frequency of 60 GHz.

In FIGS. 9(*a*) through 9(*c*), the location of the strip line on the upper surface of the dielectric layer is indicated by the dashed lines for reference. As can be seen from FIGS. 9(*a*) through 9(*c*), the strip line extends in the x-axis direction so as to cross the center of the grounding conductor portion. The microstrip line is fed through a port provided on the negative side of the x-axis, while a port provided on the positive side of the x-axis for the microstrip line is designed to reflect no inserted electromagnetic field. The strip line has a width of 0.3 mm.

The dielectric layer (not shown in FIG. 9) is provided on the positive side of the z-axis with respect to the grounding conductor portion. The dielectric layer of this specific example is a substrate made of a material with a dielectric constant of 3.5 and has a thickness of 0.3 mm.

Figure 10:
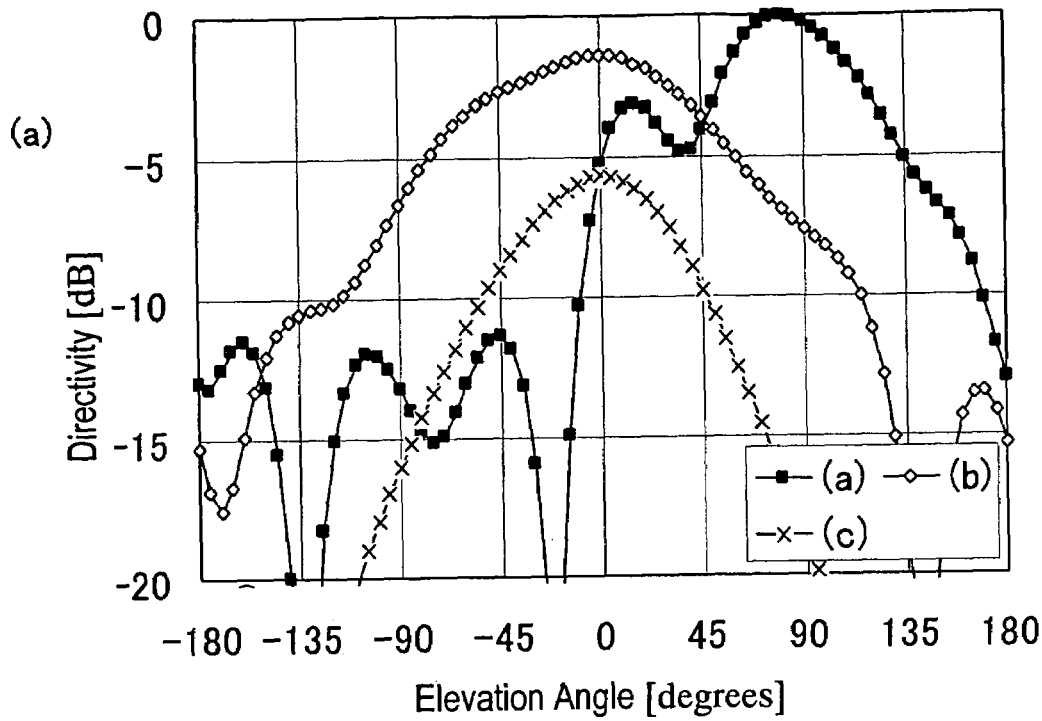
FIG. 10(*a*) is a graph showing the xz plane directivity of the second specific example of the first preferred embodiment of the present invention, and FIG. 10(*b*) is a graph showing the yz plane directivity of the second specific example.
Figure 10:
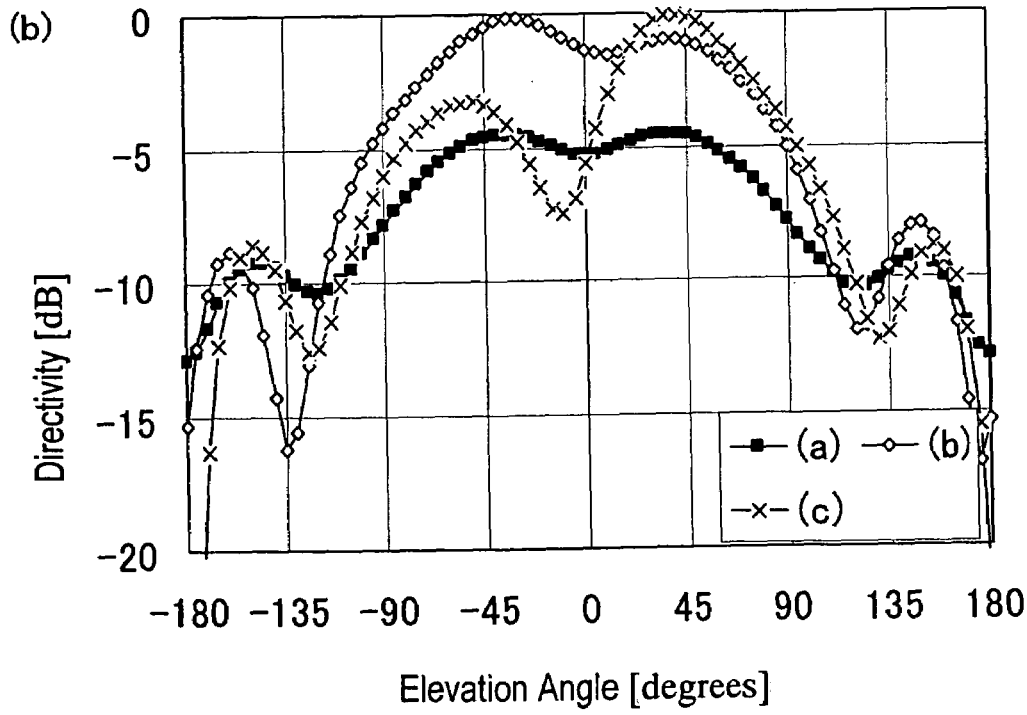

The farfield radiation directivity patterns in xz plane and yz plane at a frequency of 30 GHz were evaluated for each of the antennas shown in FIGS. 9(*a*) through 9(*c*). FIG. 10(*a*) is a graph showing the farfield radiation directivity in xz plane, while FIG. 10(*b*) is a graph showing the farfield radiation directivity in yz plane. The directivity values are normalized such that the value in the maximum radiation direction becomes 0 dB.

As can be seen from FIG. 10(*a*), the antenna having the shape shown in FIG. 9(*a*) had directivity in the +x direction (at an elevation angle of about 80 degrees). On the other hand, the antennas having the shapes shown in FIGS. 9(*b*) and 9(*c*) had the highest directivity in the vicinity of the zenith.

Also, as can be seen from FIG. 10(*b*), the antenna having the shape shown in FIG. 9(*a*) exhibited substantially uniform directivity in the range of −90 degrees to +90 degrees. Meanwhile, the antenna having the shape shown in FIG. 9(*b*) had high directivity in the vicinity of −40 degrees. And the antenna having the shape shown in FIG. 9(*c*) had high directivity in the vicinity of +40 degrees.

Thus, by adjusting the surface shape of the grounding conductor portion with the respective conductor elements displaced independently of each other, the radiation directivity of the antenna can be controlled.

As can be seen by comparing the first and second specific examples, if the displacement pattern of the conductor elements 104-1 through 104-25 is changed, then the frequency of the electromagnetic wave to radiate can also be changed and the radiation characteristics of the antenna can be adjusted in various manners. This flexibility of the radiation characteristics is not realized without implementing the grounded conductors as a two-dimensional array of conductor elements and displacing the conductor elements individually. Consequently, the antenna radiation characteristics can be optimized dynamically and adaptively in response to any change in radio wave propagation environment.

Embodiment 2

Hereinafter, a second preferred embodiment of an antenna according to the present invention will be described.

Figure 11:
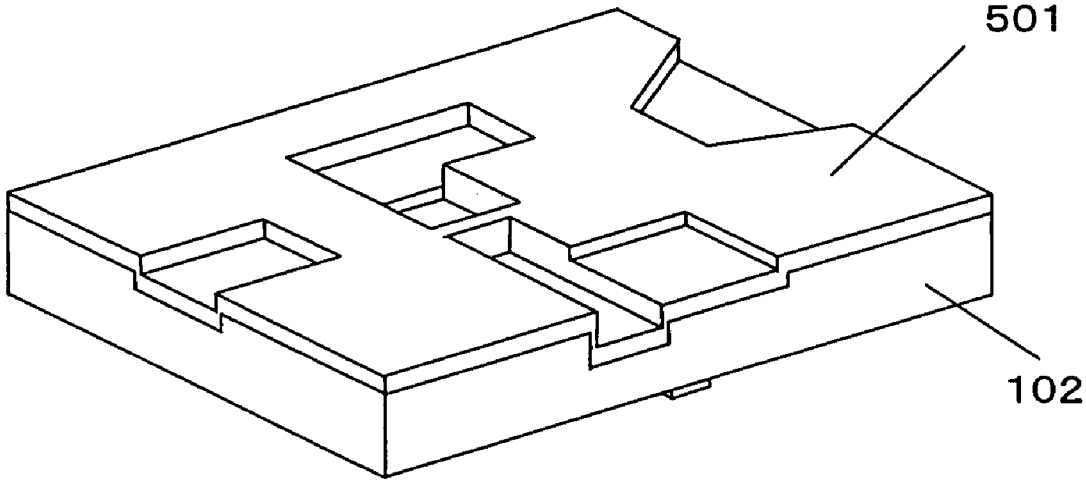
FIGS. 11(*a*) and 11(*b*) are respectively a perspective view and a cross-sectional view illustrating a second preferred embodiment of an antenna according to the present invention.
Figure 11:
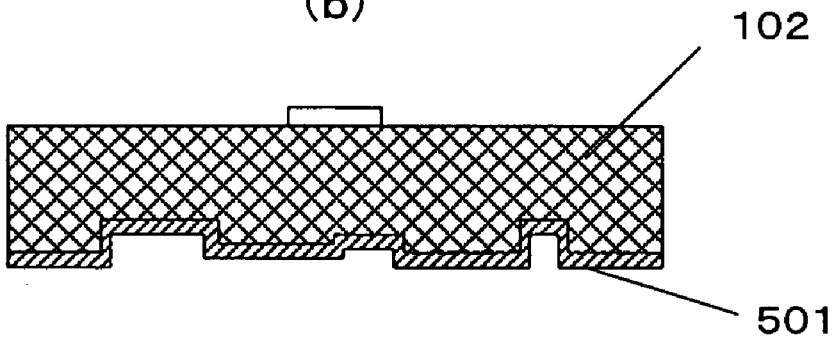

First, referring to FIGS. 11(*a*) and 11(*b*), illustrated are a perspective view showing the lower surface of an antenna according to this preferred embodiment in FIG. 11(*a*) and a cross-sectional view of the antenna of this preferred embodiment in FIG. 11(*b*), respectively.

Just like the grounding conductor portion 104 of the first preferred embodiment the grounding conductor portion 501 of this preferred embodiment also has a surface, on which the distance from a virtual reference plane changes from one location to another. However, the antenna of this preferred embodiment is quite different from the counterpart of the first preferred embodiment in that the grounding conductor portion 501 is not divided into a plurality of conductor elements.

Hereinafter, a preferred method of making the antenna shown in FIG. 11 will be described with reference to FIGS. 12(*a*) through 12(*c*).

Figure 12:
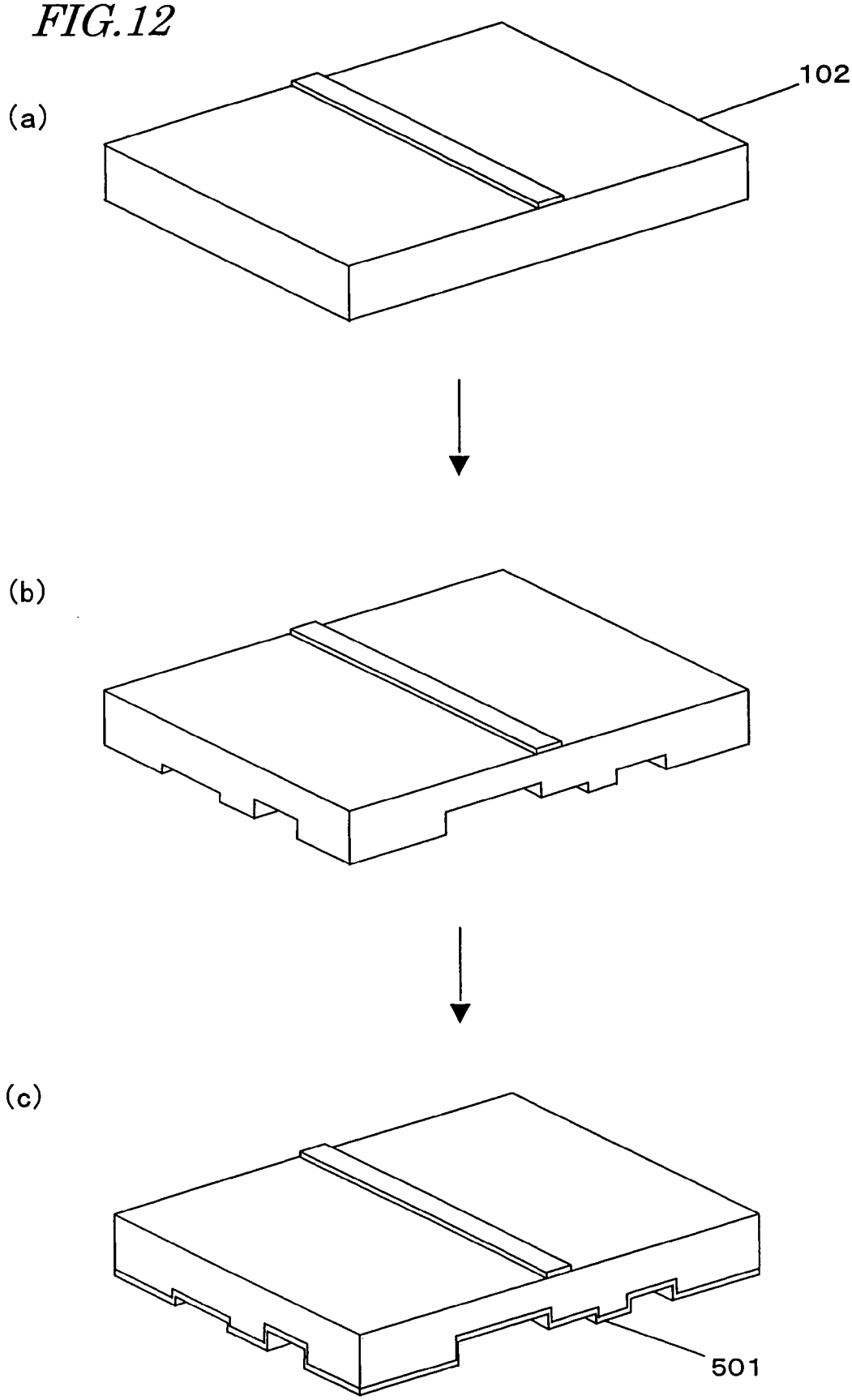
FIGS. 12(*a*) through 12(*c*) are perspective views illustrating a manufacturing process according to the second preferred embodiment of the present invention.

First, as shown in FIG. 12(*a*), a dielectric layer 102, including a signal line strip on its upper surface, is prepared. This dielectric layer 102 is a dielectric substrate, which may be made of a ceramic such as alumina or sapphire, a semiconductor material such as gallium arsenide or silicon, a plastic material such as fluorine resin, a composite material such as duroid, epoxy or any other material (see R. Garg et al., Microstrip Antenna Design Handbook, Artech House, Norwood, Mass., 2001) and of which the thickness is adjusted to the range of about 0.1 mm to about 1.0 mm. Thereafter, the other surface (i.e., lower surface) of the dielectric layer 102 is patterned by an etching or any other process, thereby obtaining a dielectric layer 102 with the structure shown in FIG. 12(*b*).

Next, the patterned surface of the dielectric layer 102 is metalized by either a thin film deposition technique such as a sputtering process or a plating technique, thereby forming a grounding conductor portion 501 on the patterned surface. The grounding conductor portion 501 may be made of a material such as copper, silver, gold or aluminum and may have a thickness of about 0.01 mm to about 0.1 mm.

In this preferred embodiment, the grounding conductor portion 501 to be deposited by a sputtering process has a substantially uniform thickness irrespective of the location on the dielectric layer 102. However, the thickness of the conductor portion 501 does not have to be uniform. Also, if the film being deposited to make the grounding conductor portion 501 has bad step coverage, then the thickness of the grounding conductor portion 501 may be either very small or even zero at a stepped portion of the patterned surface. The antenna could be designed so as not to cause any inconvenience even in such a situation. However, to increase the step coverage and prevent the conductor portion 501 from being discontinued at such a stepped portion, the stepped portions of the patterned surface are preferably tapered.

The grounding conductor portion 501 does not have to cover the patterned surface of the dielectric layer 102 entirely. Optionally, areas with no conductor portion 501 may be provided intentionally. In that case, a conductor film to be the grounding conductor portion 501 may be deposited on the patterned surface of the dielectric layer 102 and then patterned.

However, the method of making the dielectric layer 102 with the patterned surface is not limited to the process of etching the flat dielectric substrate as described above. Alternatively, a flat dielectric substrate may be prepared and then a dielectric material may be provided on a selected area of one surface of the dielectric substrate. More specifically, a dielectric film may be deposited on one surface of the dielectric substrate and then excessive portions of that dielectric film may be removed by an etching process. In that case, the dielectric substrate prepared in the first process step may or may not be etched. Optionally, an etch stop layer may be interposed between the dielectric substrate and the dielectric film. Or the dielectric substrate and the dielectric film may be made of a combination of materials that achieves high etch selectivity.

To define unevenness with various depths on the patterned surface, the etching process may be carried out in variable amounts of time from one location to another. More particularly, a mask pattern that covers a selected area of the dielectric substrate is defined and then portions of the substrate that are not covered with this mask pattern are etched to a predetermined depth. This etching process may be either a physical etching process such as ion beam etching or sandblasting or a chemical etching process that uses a gas or a chemical exhibiting reactivity against the dielectric substrate. Unevenness with multiple different depths or heights may be defined by repeatedly performing the process steps of defining a mask pattern, etching non-masked portions, defining a different mask pattern and etching exposed portions a number of times.

It should be noted that if the dielectric layer 102 is made of a resin material, the dielectric layer 102 with the desired patterned surface may be formed by an injection molding process, for example. If the dielectric layer 102 with the desired patterned surface is obtained in this manner, the signal line strip and grounding conductor portion may be made on the dielectric layer 102 after that.

By adopting this process, the surface shape of the grounding conductor portion of the antenna can be designed flexibly enough. And such a design contributes to changing the two-dimensional distribution of the electromagnetic field in the grounding conductor portion and thereby changing the pattern of the electric or magnetic current flowing through the grounding conductor portion. Consequently, the antenna properties can be optimized according to the frequency of the radio wave signal to transmit or receive or the environment surrounding the antenna.

This process does not allow the user to change the shape of the grounding conductor portion dynamically once the antenna has been made. Nevertheless, the design of the antenna can be optimized to any of various applications or operating environments. Also, the shape of the grounding conductor portion in the antenna of this preferred embodiment is preferably optimized by using the antenna of the first preferred embodiment in a radio wave environment where the antenna of this preferred embodiment is supposed to be used.

If the shape of the grounding conductor portion is optimized by using the antenna of the first preferred embodiment, then the surface of the grounding conductor portion in the resultant antenna is affected by the arrangement pattern of the conductor elements 104-1 through 104-N shown in FIG. 1. That is to say, the antenna is designed such that the surface of the dielectric layer 102, on which the grounding conductor portion 501 is going to be provided, includes a plurality of unit areas (each of which has a size that is shorter than the wavelength of the radio wave to transmit or receive and), which are arranged in columns and rows so as to define a matrix pattern, and that the distance from the surface of each of those unit areas to a reference plane has a predetermined value on an area-by-area basis. In that case, the respective surfaces of the unit areas are typically substantially parallel to the reference plane.

EXAMPLE 3

Hereinafter, a specific example of the second preferred embodiment will be described with reference to FIGS. 13(*a*) and 13(*b*).

Figure 13:
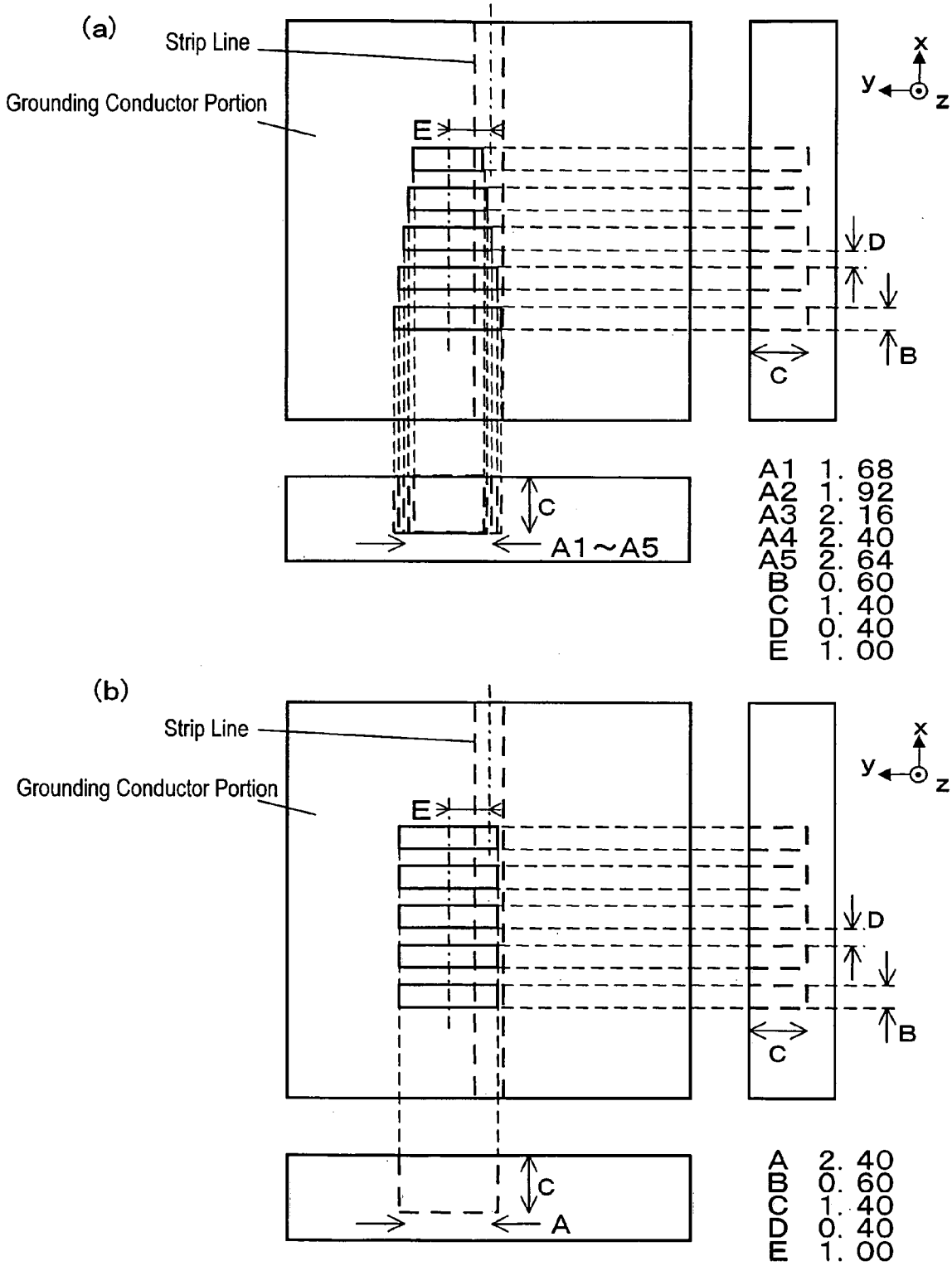
FIGS. 13(*a*) and 13(*b*) illustrate specific examples of the second preferred embodiment of the present invention.

FIGS. 13(*a*) and 13(*b*) illustrate the surface shapes of grounding conductor portions for two types of antennas. Each of these grounding conductor portions includes a substrate, on which a plurality of grooves have been cut, and a conductor layer deposited on the surface of the substrate. The substrate has a square shape with a size of 10 mm each side and a thickness of about 0.3 mm. A cross section parallel to the yz plane and a cross section parallel to the xz plane are shown in FIGS. 13(*a*) and 13(*b*), respectively.

In the antenna shown in FIG. 13(*a*), five grooves with lengths A1 through A5, a width B and a depth C are arranged in the x-axis direction at an interval D. The center of these grooves has shifted from the strip line by a distance E in the y direction. In the antenna shown in FIG. 13(*b*) on the other hand, five grooves with a length A, the width B and the depth C are arranged in the x-axis direction at the interval D. The center of these grooves has also shifted from the strip line by the same distance E in the y direction.

The dielectric layer and the strip line are the same as the counterparts of any of the specific examples described above. In this specific example, the microstrip line is also fed through a port provided on the positive side of the x-axis and a port provided on the negative side of the x-axis for the microstrip line reflects no inserted electromagnetic field.

Figure 14:
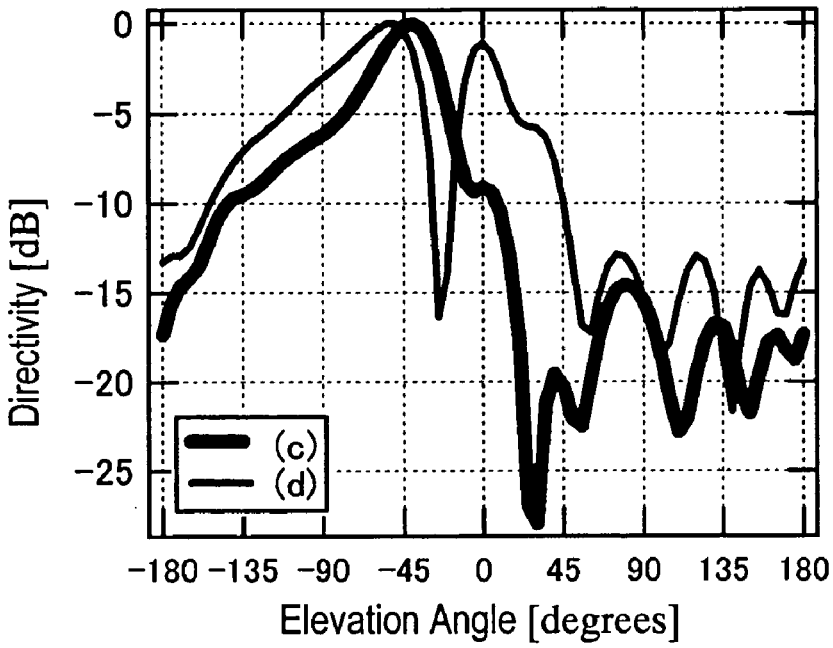
FIG. 14 is a graph showing the xz plane directivity of a specific example of the second preferred embodiment of the present invention.
Figure 15:
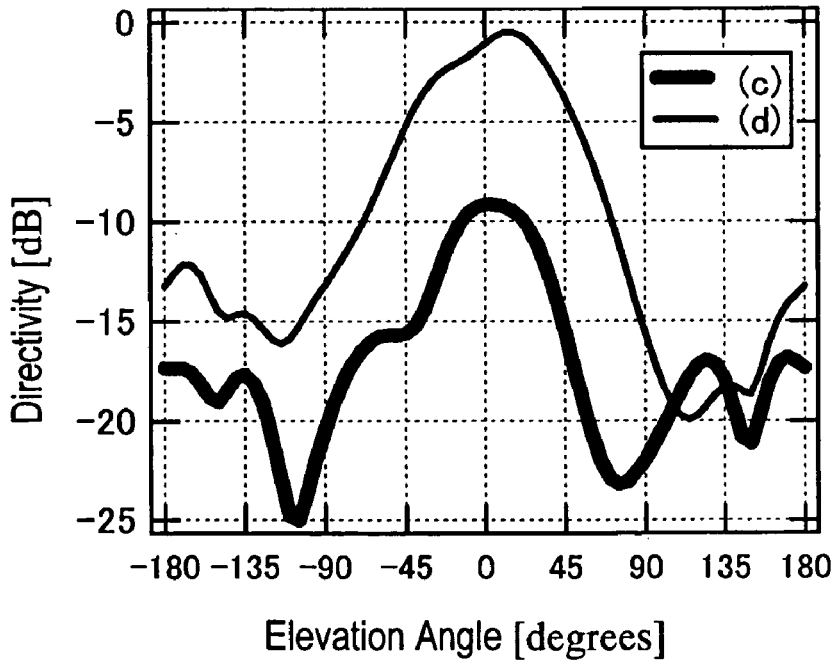
FIG. 15 is a graph showing the yz plane directivity of the specific example of the second preferred embodiment of the present invention.

As is done in the first specific example, the farfield radiation directivity patterns in xz plane and yz plane at a frequency of 60 GHz were also evaluated for each antenna of this specific example. FIG. 14 is a graph showing the farfield radiation directivity in xz plane, while FIG. 15 is a graph showing the farfield radiation directivity in yz plane. In FIGS. 14 and 15, the curve (c) plots data about the antenna shown in FIG. 13(*a*) and the curve (d) plot data about the antenna shown in FIG. 13(*b*).

As can be seen from FIG. 14, the antenna shown in FIG. 13(*b*) forms the null direction at an elevation angle of −25 degrees. On the other hand, the antenna shown in FIG. 13(*a*) exhibits moderate directivity in the forward and upward direction (where the elevation angle is −90 degrees to 0 degrees) but just low directivity in the backward direction (where the elevation angle is positive).

Also, as can be seen from FIG. 15, the antenna shown in FIG. 13(*a*) has lower directivity than the antenna shown in FIG. 13(*b*) in almost all directions in yz plane and exhibits high radiation directivity in the forward and upward direction. Thus, by cutting grooves or recesses on the surface of the grounding conductor portion and by changing their shapes or arrangement, the radiation directivity of the antenna can be changed.

In this preferred embodiment, the grooves are cut on the lower surface of the dielectric substrate as shown in FIGS. 13(*a*) and 13(*b*). Alternatively, the uneven pattern shown in FIG. 6 may be defined on the lower surface of the dielectric substrate. Also, the shapes of the grounding conductor portions shown in FIGS. 13(*a*) and 13(*b*) may also be formed by using the conductor elements of the first specific example. In that case, the shapes and arrangement of the grooves can be changed dynamically and adaptively. As a result, the antenna radiation characteristics can be controlled according to the radio wave propagation environment.

In each of the preferred embodiments described above, the dielectric layer 102 is made of a solid dielectric material. Alternatively, the dielectric layer 102 may also be made of a fluid (e.g., the air) or may be a multilayer structure consisting of a number of different dielectric materials stacked. Furthermore, the dielectric layer 102 does not have to be flat but may be curved. The feeding conductor pattern is not limited to the illustrated strip pattern, either. The supporting member 103 illustrated is just an example. Optionally, the supporting member 103 may have a shape with substantially no frame-like raised portions or even a more complex shape.

Embodiment 3

Hereinafter, a method for optimizing the shape of the grounding conductor portion by using the antenna of the first preferred embodiment of the present invention will be described.

Figure 16:
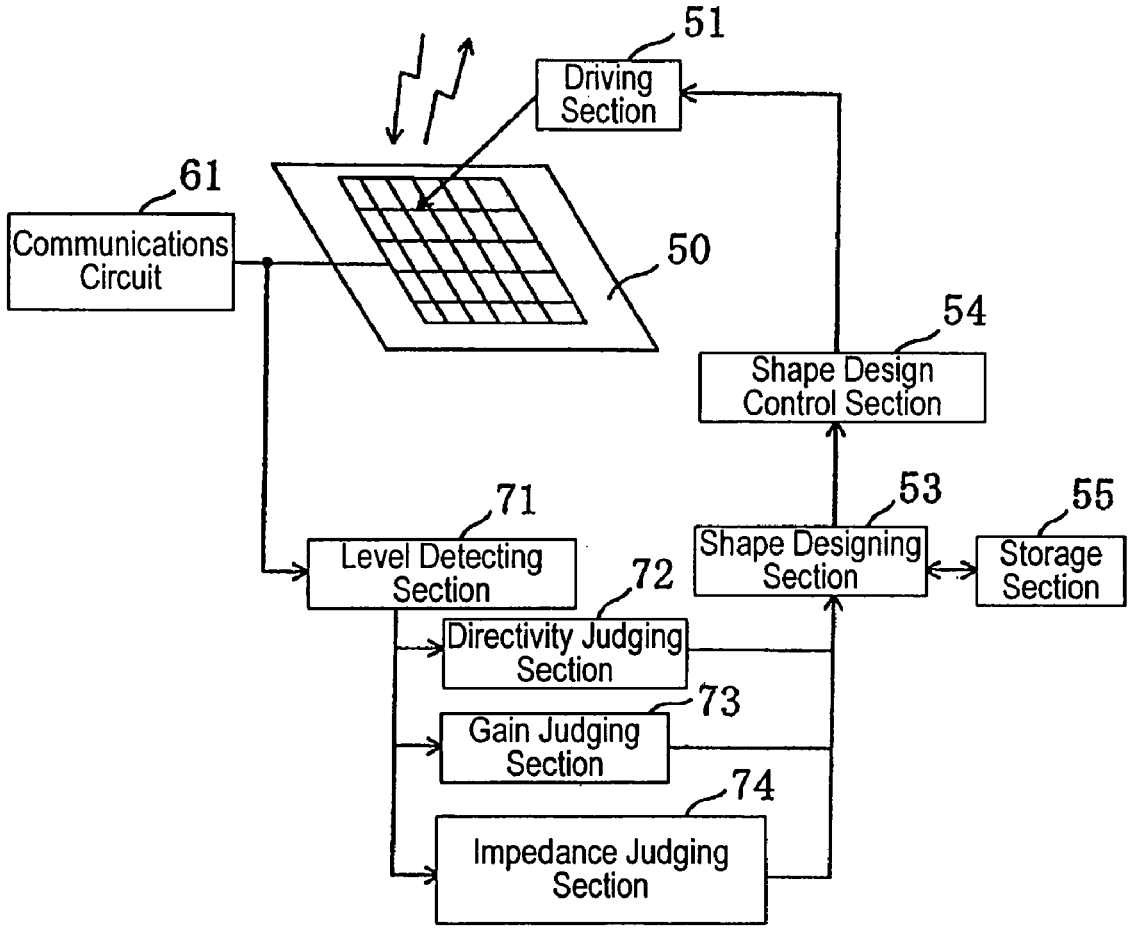
FIG. 16 is a block diagram showing an exemplary apparatus including an antenna according to the first preferred embodiment of the present invention.
Figure 17:
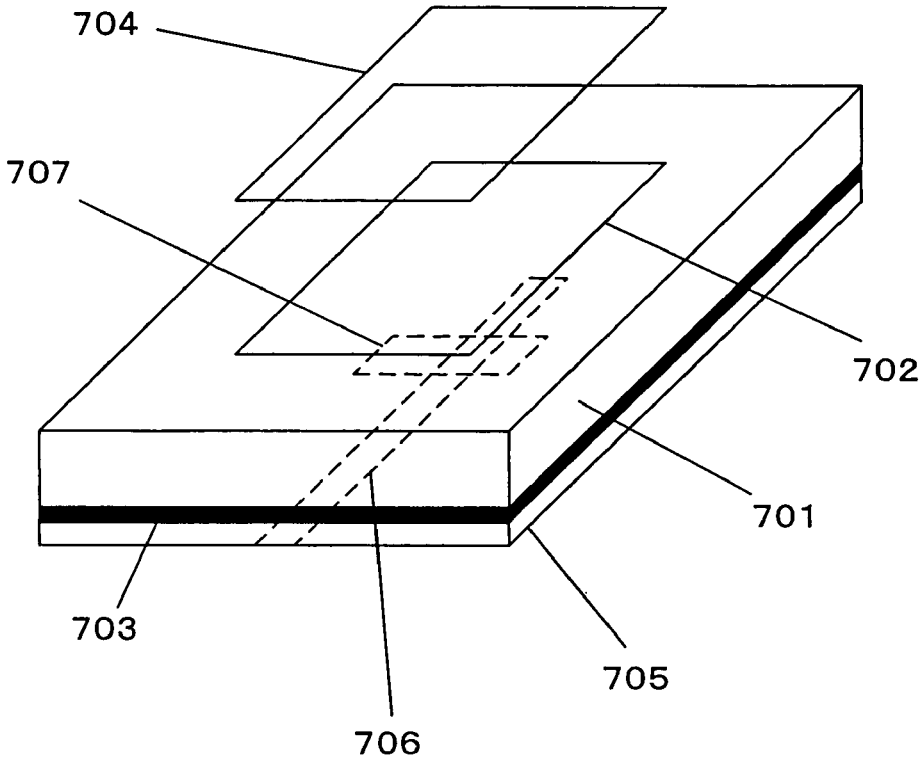
FIG. 17 schematically illustrates a conventional microstrip antenna.
Figure 18:
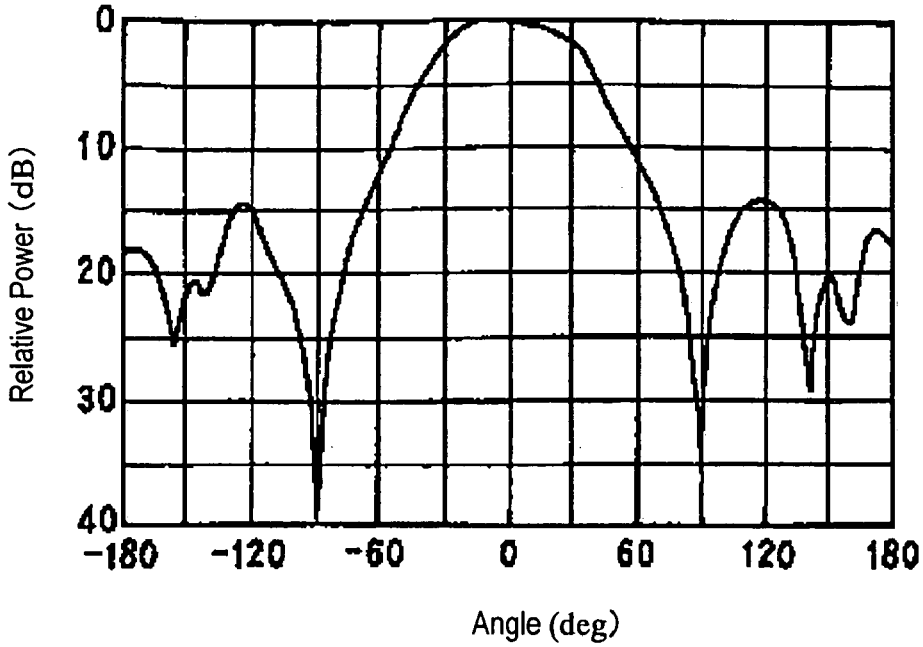
FIG. 18 shows the directivity of the conventional microstrip antenna.

FIG. 16 is a block diagram showing an exemplary apparatus including an antenna according to the present invention.

As shown in FIG. 16, the apparatus of this preferred embodiment includes an antenna 50 according to the first preferred embodiment of the present invention, a communications circuit 61 connected to the antenna 50, and a control section for controlling the shape of the grounding conductor portion of the antenna 50 (which will be referred to herein as the "antenna shape").

The apparatus further includes a driving section 51 that changes, along z-axis, positions of the conductor elements included in the antenna 50, a designing section 53 for determining the antenna shape, a shape design control section 54 for controlling the driving section 51 and a storage section 55 for storing information about the antenna. The antenna information stored in the storage section 55 includes the sizes of the conductor elements and dielectric substrate and initial conditions on the shape of the grounding conductor portion.

This apparatus further includes a power level detecting section 71 for detecting the power level of the signal to be transmitted or received by the antenna 50, a radiation directivity judging section 72 for sensing the radiation directivity of the antenna 50 based on the signal power level that has been detected by the power level detecting section 71, a gain judging section 73 for figuring out the gain on the signal power level detected, and an impedance judging section 74 for determining, by the signal power level detected, whether or not impedance is matched between the antenna 50 and the communications circuit 61.

Hereinafter, it will be described how this apparatus operates.

First, in accordance with the information stored in the storage section 55, the shape designing section 53 determines the initial antenna shape. Next, following the design adopted by the shape designing section 53, the shape design control section 54 controls the driving section 51 such that the shape of the grounding conductor portion of the antenna 50 becomes just as designed. In response, the driving section 51 drives actuators and so on such that the respective conductor elements of the grounding conductor portion of the antenna 50 form a desired antenna shape.

The antenna 50 can be used for both transmission and reception purposes. That is why the shape of the antenna 50 is preferably optimized independently when the antenna is made to function as a transmitting means and when the antenna is made to function as a receiving means.

Hereinafter, it will be described how to adjust the shape when the antenna 50 is used as a transmitting antenna.

First, the communication circuit 61 sends a signal to transmit to the antenna 50. This signal is also input to the power level detecting section 71. In this preferred embodiment, a directional coupling member is provided for an RF signal on the signal path between the communications circuit 61 and the antenna 50. Accordingly, even if the signal has been transferred from the communications circuit 61 to the antenna 50, it is possible to make adjustments so as to prevent the signal reflected by the antenna 50 from returning to the communications circuit 61. The power level detecting section 71 can detect both the power level of the signal transferred from the communications circuit 61 to the antenna 50 and that of the signal reflected by the antenna 50.

By the RF signal power level detected by the power level detecting section 71, the directivity judging section 72 determines whether or not the directivity of the antenna 50 during the transmission falls within a permissible range. More specifically, in a situation where the power level of the signal reflected by the antenna 50 changes with the direction that the antenna 50 faces, the directivity is regarded as falling within the permissible range if the power level difference of the reflected signal in respective directions is within a certain range. Otherwise, the directivity is regarded as falling out of the permissible range. In this manner, the radiation directivity of the antenna 50 during the transmission is judged good or bad. However, the radiation directivity sometimes should be as low as possible and sometimes should be as high as possible. For that reason, the judgment range shifts with the type and application of the equipment that uses the antenna and depending on whether the antenna is transmitting or receiving.

The gain judging section 73 regards the gain of the antenna 50 as good or bad by determining whether or not the power level ratio of the signal to transmit, which has been transferred from the communications circuit 61, to the signal reflected by the antenna 50 falls within a permissible range, for example. In general, that power level ratio of the signal to transmit to the reflected signal is preferably as high as possible. That is why the gain is judged to be good if this ratio is equal to or greater than a certain value.

The impedance judging section 74 judges the impedance matching between the communications circuit 61 and the antenna 50 good or bad by determining whether or not the power level ratio of the output signal of the communications circuit 61 to the signal reflected by the antenna 50 falls within a permissible range, for example. If the power level ratio of the reflected signal to the input signal of the antenna 50 is high, then it usually means that impedance matching has not been achieved sufficiently. Thus, if the power level ratio is equal to or greater than a certain value, the impedance matching is judged to be good.

The shape designing section 53 preferably redesigns the antenna shape over and over again and the antenna 50 is preferably reshaped dynamically by the shape design control section 54 and driving section 51 until the radiation directivity, gain and impedance matching are all judged good. And when the radiation directivity, gain and input impedance matching of the antenna 50 are finally judged all good, the information (data) about that shape is stored in the storage section 55.

It should be noted that not all of the radiation directivity, gain and impedance matching have to be judged good. For example, the shape of the antenna 50 may be optimized in a case in which the radiation directivity is thought much of but the gain is thought little of.

In the example described above, the change of antenna shape and the assessment of antenna properties are repeatedly carried out. Alternatively, a plurality of antenna shape patterns, associated with various propagation environments of radio wave, may be stored in advance in the storage section, and an appropriate antenna shape may be selected from those patterns when any change in the propagation environment of radio wave is sensed. That selection may be done either automatically by the apparatus or arbitrarily by the user of the apparatus.

As can be seen, if such an antenna module, in which a circuit for controlling the driving section of conductor elements and an antenna are integrated together, is built in a personal digital assistant, a cell phone or any other mobile communication device, then an apparatus that can optimize the antenna properties dynamically and adaptively can be obtained.

According to the present invention, even if the strip line does not have a radiation structure with a particular resonant frequency, the frequency band of the electromagnetic wave radiated can be defined by controlling the shape of the grounded conductors. Thus, the frequency band and radiation directivity of the electromagnetic wave radiated can be designed without depending on the strip line pattern. For example, a rectangular waveguide type resonant structure with short-circuited end faces can be provided on the grounded conductor plane. Likewise, a plurality of resonator structures with mutually different resonant frequencies may be made at the same time or the resonant frequency may be changed by reshaping the grounded conductors. As a result, the frequency band of the electromagnetic wave radiated changes.

Also, not just the resonant antenna but also a non-resonant antenna such as a leaky wave antenna may be designed as well. Optionally, such a resonator structure and a structure producing a leaky wave may be switched, too. It should be noted that the radiation mechanism is not limited to the waveguide resonance or leaky wave.

The radiation directivity may be changed by modifying not just the radiation structure such as the waveguide type resonator described above but also a portion not contributing to the resonant frequency significantly. Also, the radiation directivity and gain may be varied even by changing the positional relationship between the radiation structure and the feed line or by shifting the location within the substrate plane.

Optionally, a number of radiation structures may be provided and the radiation directivity of an electromagnetic wave, which is produced as a combination of multiple radiations, may also be controlled.

As described above, an electric vector potential and a magnetic vector potential are given by Equations (1) and (2) using the electric and magnetic currents flowing through the grounding conductor portion. The antenna needs to be shaped such that the electric vector potential and the magnetic vector potential have finite values. However, by adopting the structure of the present invention, various properties of the antenna may be defined such that these potentials have finite values. Since various antenna properties are realized in this manner, the best shape of grounded conductors, which satisfies a number of specifications including the frequency band and the radiation directivity most completely, can be searched for, found and actually used.

The antenna of the present invention can adapt its radiation characteristics to the given radio wave propagation environment, and can be used effectively as an antenna for a cell phone, a wireless LAN or any other mobile communication device.

While the present invention has been described with respect to preferred embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

This application is based on Japanese Patent Application No. 2003-303376 filed Aug. 27, 2003, the entire contents of which are hereby incorporated by reference.

What is claimed is:

1. An antenna comprising:

a dielectric layer with an upper surface and a lower surface;

a feeding conductor pattern, which is provided on the upper surface of the dielectric layer; and a grounding conductor portion, which is provided on the lower surface of the dielectric layer, wherein the surface of the grounding conductor portion includes a plurality of planar areas, each of which has a size that is shorter than the wavelength of an electromagnetic wave to transmit or receive, wherein a distance from a virtual reference plane to each said planar area is adjusted on an area-by-area basis, wherein the grounding conductor portion includes an array of conductor elements, each of which defines an associated one of the planar areas, and wherein the distance from at least one of the conductor elements to the reference plane is changeable.

2. The antenna of claim 1, comprising a driving section, which is able to change the distance from the at least one selected conductor element to the reference plane.

3. The antenna of claim 2, wherein the driving section is able to change respective positions and/or directions of some of the conductor elements independently of each other.

4. The antenna of claim 3, wherein the driving section includes an actuator produced by an MEMS.

5. The antenna of claim 3, wherein each said conductor element has a principal surface that is parallel to the reference plane, and wherein the driving section is able to move the principal surface up and down perpendicularly to the reference plane while keeping the principal surface parallel to the reference plane.

6. The antenna of claim 1, wherein the conductor elements are arranged in columns and rows to define a matrix pattern.

7. The antenna of claim 6, wherein each said conductor element has a rectangular principal surface, the sizes of the respective principal surfaces being substantially equal to each other.

8. The antenna of claim 1, wherein the at least one selected conductor element is grounded to define a grounded conductor portion.

9. The antenna of claim 1, wherein the dielectric layer is an air layer.

10. The antenna of claim 1, wherein the dielectric layer is a dielectric plate.

11. The antenna of claim 1, wherein the feeding conductor pattern includes a signal line strip.

12. An apparatus comprising:

the antenna of claim 1, and a circuit, which is electrically connected to the feeding conductor pattern and the grounding conductor portion of the antenna.

13. An antenna control system comprising:

the antenna of claim 1;

a circuit, which is electrically connected to the feeding conductor pattern and the grounding conductor portion of the antenna;

an antenna shape control section for controlling the shape of the antenna so as to change a distance from at least one of the conductor elements to the reference plane; and antenna property assessing means for assessing the antenna properties of the antenna by transmitting and/or receiving electromagnetic wave through the antenna with the circuit operated, wherein based on the antenna properties assessed by the antenna property assessing means, the distances from the conductor elements to the reference plane are determined and the shape of the antenna is controlled.

14. An apparatus comprising:

the antenna of claim 1;

a circuit, which is electrically connected to the feeding conductor pattern and the grounding conductor portion of the antenna; and a control section for controlling the shape of the antenna so as to change a distance from at least one of the conductor elements to the reference plane.

15. A method of making an antenna, the method comprising the steps of:

(a) preparing the antenna of claim 1;

(b) controlling the shape of the antenna so as to change a distance from at least one of the conductor elements to the reference plane;

(c) assessing the antenna properties of the antenna; and (d) determining the distances from the conductor elements to the reference plane based on the antenna properties assessed by performing the steps (b) and (c) at least once.

16. A method of controlling an antenna, the method comprising the steps of:

(a) preparing the antenna of claim 1;

(b) controlling the shape of the antenna so as to change a distance from at least one of the conductor elements to the reference plane;

(c) assessing the antenna properties of the antenna;

(d) determining the distances from the conductor elements to the reference plane based on the antenna properties assessed by performing the steps (b) and (c) at least once; and (e) controlling the shape of the antenna based on the distances, determined in the step (d), so as to change the distance from the at least one selected conductor element to the reference plane.

* * * * *